United States Patent [19]

Lanz

[11] 4,294,012

[45] Oct. 13, 1981

[54] CHAIN SAW ANTI-PINCH GUARD ARM

[76] Inventor: Donald D. Lanz, 15702 S. Neibur Rd., Oregon City, Oreg. 97045

[21] Appl. No.: 133,915

[22] Filed: Mar. 25, 1980

[51] Int. Cl.[3] ..... B27B 17/00

[52] U.S. Cl. ..... 30/378; 30/382

[58] Field of Search ..... 30/381, 382, 383, 371, 30/378, 166 R, 166 A

[56] References Cited

U.S. PATENT DOCUMENTS

| | | | |
|---|---|---|---|
| 3,636,996 | 1/1972 | Lanz | 30/371 |
| 3,715,805 | 2/1973 | Fraser | 30/166 |
| 3,834,019 | 9/1974 | Smeltzer | 30/378 X |
| 3,991,470 | 11/1976 | Cartmill | 30/382 |
| 4,060,894 | 12/1977 | Hampton | 30/382 |

*Primary Examiner*—Jimmy C. Peters

*Attorney, Agent, or Firm*—Eugene D. Farley

[57] ABSTRACT

A chain saw antipinch guard arm including an arm attached pivotally to a chain saw, the arm being movable in a plane substantially parallel to the plane of the blade. A handle extends upwardly from the arm and is pivotal therewith. The arm may be manipulated by the saw operator with a scissor-like action with respect to the blade and may be used for applying a force to the underside of a piece being sawn, thereby preventing pinching of the blade, while at the same time protecting the operator from injury.

20 Claims, 4 Drawing Figures

CHAIN SAW ANTI-PINCH GUARD ARM

BACKGROUND OF THE INVENTION

This invention relates to chain saw guard structures, and more particularly to an antipinch guard arm having a handle attached thereto which permits the saw operator to control the angular position of the guard arm.

A problem commonly encountered in the use of chain saws is that of pinching. As the cut progresses, the log collapses against the blade and binds the saw chain.

When bucking a large diameter log this problem may be corrected by driving a wedge in the kerf. However, wedges may not be used when bucking logs of a small diameter, because of interference of the wedge with the saw chain.

A second common problem attending the use of chain saws is that of dulling the saw chain. Where the log or other object being sawn rests on or near the ground, the blade of the saw is prone to drop downwardly at the conclusion of each cut. The free-running saw chain thereupon engages the underlying dirt and rocks. This obviously dulls the chain so that it must be resharpened frequently.

My previous U.S. Pat. No. 3,636,996 discloses an antipinch guard arm attached pivotally to a saw. The arm has free angular movement between an initial position downwardly divergent from the working stretch of the saw chain, and a second position substantially aligned with the working stretch of the saw chain. Because of the free movement the operator of the saw has little control over the angular position of the arm.

Accordingly, it is the general object of the present invention to provide an antipinch guard arm having the advantages of my previously disclosed invention, and having the further advantage that the operator has control over the angular position of the arm.

It is another object of this invention to provide a guard arm which may be scissored in any orientation of the saw.

Another object of this invention is to eliminate the need for the conventional dog toothed bucking plate.

A further object of this invention is to eliminate the need for a secondary peripheral handle conventionally attached to the saw.

It is another object of this invention to provide a chain saw having less chance of injury due to kick-back.

It is yet another object of this invention to provide an antipinch guard arm which is universal in mounting to any chain saw.

It is a further object of the present invention to provide stops for the angular movement of the guard arm which are adjustable.

Other objects and advantages of the present invention will become apparent upon further consideration of the following specification and claims.

BRIEF SUMMARY OF THE INVENTION

In its basic concept the improved chain saw antipinch guard arm of the present invention includes a guard arm and an attached handle pivotally mounted on a chain saw so that the arm is movable between an initial position divergent to the working stretch of the chain, and a second position substantially parallel to the working stretch of the chain. The operator of the chain saw may scissor the guard arm with respect to the blade of saw, thus grasping an article to be sawn and pushing it against the working stretch of the chain.

DETAILED DESCRIPTION OF THE PREFERRED EMBODIMENT

Figures 1, 2, 3, 4:
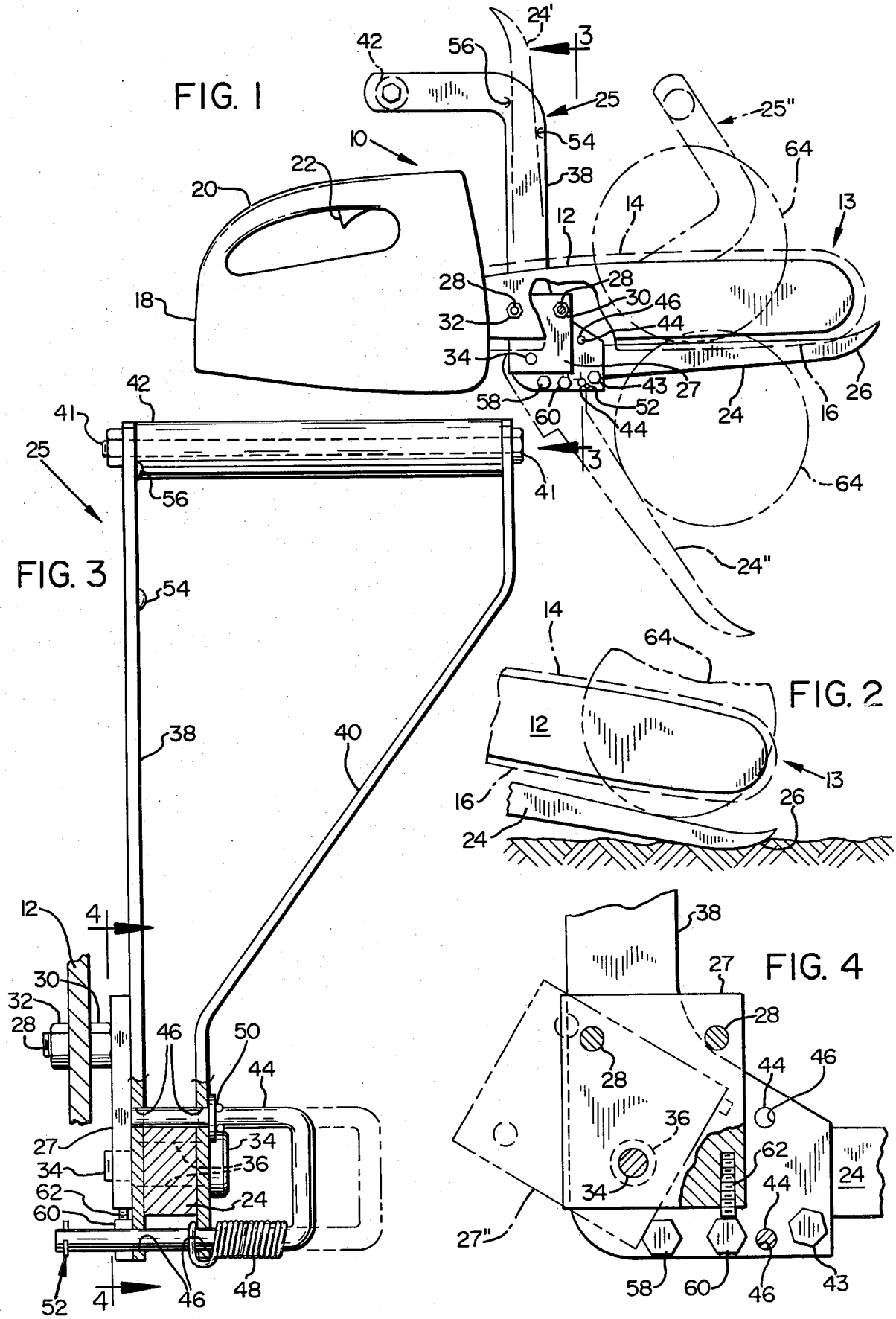
FIG. 1 is a side elevation view of a chain saw, including the improved chain saw antipinch guard arm of the present invention, with part of the blade thereof broken away showing the guard arm attachment.
FIG. 2 is a fragmentary side elevation view illustrating the antipinch action of the presently described chain saw guard arm.
FIG. 3 is an end elevation in partial section taken along the line 3—3 of FIG. 1.
FIG. 4 is a fragmentary side elevation in partial section taken along the line 4—4 of FIG. 3.

As shown in FIG. 1 the antipinch guard attachment of my invention mounts on a chainsaw shown generally at 10, preferably on the blade 12 thereof. The blade of the chain saw conventionally mounts a saw chain 13 having an upper stretch 14 and a lower, or working stretch 16. The case 18 of the chain saw includes the motor assembly and mounts a handle 20 to which a throttle trigger 22 is pivotally attached.

With the present guard attachment, the conventional bow-like peripheral handle, and the dog toothed bucking plate are not necessary, and consequently are not shown in the drawings, although their inclusion will not affect the operation of the attachment.

The antipinch guard attachment comprises an arm 24 which has substantial strength and resistance to bending, a pivotal mounting means mounting the arm to the saw 10, and a handle means, shown generally at 25, attached to the arm. The arm includes a rounded end or foot 26 operable to rest against the ground as shown in FIG. 2.

The pivotal mounting means preferably comprises a plate 27 attached to the blade 12 of the saw by bolts 28. As best shown in FIG. 3, the plate is spaced apart from the saw blade by washers or sleeve 30 and tightened by nuts 32.

A shaft such as shoulder bolt 34 is attached to the plate and extends outwardly perpendicular to the plane of the blade. The shaft provides a bearing surface 36 on which one end of the arm 24 is journaled.

The handle means 25 is preferably bifurcated, having two upstanding members 38 and 40, member 38 being substantially straight and vertical, while member 40 is bent outwardly to angle up and away from member 38. At their upper ends the upright members are bent rearwardly so that they extend over the case 18 of the saw. The lower ends of the upright members are journaled on the shaft 34 on the sides of arm 24. A hand grip 42 is fixed between the upper ends of the upright members by hand grip bolt 41.

So that the operator may be able to scissor guard arm 24, the arm may be locked in substantially perpendicular relation to the lower ends of the upright members 38 and 40. The lower surface of the arm abuts stop bolt 43. A detent 44, preferably U-shaped as shown in FIG. 3, is slidably mounted on the upright members by extending through holes 46 therein. The upper segment of the detent serves to lock the arm. The lower segment of the detent mounts a spring 48 which is operable to urge the detent through the holes, into a locked position. The detent is prevented from further extending through the holes by a boss and washer stop 50 in the upper bar.

Detent 44 may be manually pulled against the tension of the spring 48 until a cotter pin 52 in the lower segment abuts the side of upright member 38. The upper segment of the detent then permits the free upward pivotal movement of arm 24 in relation to the upright members 38 and 40.

It should be noted that although the handle 25 is preferably pivotally attached to the arm 24 coaxial with the pivoted mounting means, such need not be the case. Rather, a separate hinge means may be provided pivotally attaching the handle to the arm.

The arm 24 is lockable in a second relative position substantially parallel to the upright members shown at 24' in FIG. 1. Since the upright member 38 lies substantially in a plane, the arm is pivotable to a position adjacent thereto, and is lockable by a first boss 54 from swinging downwardly, and a second boss 56 from further swinging toward handgrip 42. The arm is releasable by merely springing the upright member so that the bosses no longer engage the arm.

The arm 24 and handle means 25 are pivotable as a unit between an initial angular position wherein the arm is downwardly divergent from the working stretch 16 of the saw chain as shown at 24'' and 25'', and a second angular position wherein the arm is adjacent and substantially aligned with the working stretch of the saw chain as shown at 24 and 25.

In the initial angular position the plate 27 assumes a position shown by 27'' in relation to the upstanding members 38 and 40 and arm 24. A first stop means, shown in FIG. 4 as the head of a bolt 58 is operable to abut the plate, preventing further pivotal movement.

A second stop means 60, similar to stop means 58, prevents further pivotal movement beyond the second angular position. A screw 62 mounts in plate 27 and provides adjustment for the angular position of the second stop. This feature is useful for adapting the attachment to various saws.

OPERATION

In operation, the arm 24 of the antipinch guard attachment is locked in perpendicular relationship to the upright members 38 and 40 of the handle means 25. The chain saw operator grasps the handle 20 of the saw, and handgrip 42. The arm may then be manipulated with a scissor-like action with respect to the blade 12 and the working stretch of the saw chain 16.

As shown in FIG. 2, the arm 24 of the attachment may then be inserted beneath a log 64 or other piece to be sawn. The working stretch of the chain 16 is engaged with the log substantially opposite the arm. When foot 26 is placed against the ground, the arm may be used to raise the log off the ground, supporting the piece sawn so that it eliminates the tendency to pinch blade 12.

At the conclusion of the cut, screw 62 abuts stop 60 and the arm 24 then acts as a guard to keep the saw chain 16 from digging into the dirt or rocks beneath the log.

When sawing small branches or brush, the arm 24 may be easily manipulated to grasp the branches and force them into the saw chain 16. It should be noted that the operator is able to scissor the arm in any position of the saw.

The likelihood of injury from kickback is reduced. When the saw accidentally kicks back, the arm 24 engages the log and slows or stops the kickback.

When it is desired to elevate arm 24, detent 44 may be retracted against the force of spring 48, allowing the arm to have free upward pivotal movement. The arm may then be contained parallel to upright member 38 by bosses 54 and 56. This allows the saw to be used conventionally when desired by the operator.

It should be noted that various modifications may be made in the structure of this invention by persons skilled in the art without departing from the scope thereof. For instance, attachment could be made directly to the case of the saw 18, rather than to blade 12, or the device could be made as an integral part of the saw structure.

Having described my invention in a preferred embodiment, I claim:

1. In combination with a chain saw having an outwardly projecting blade mounting a saw chain having a working stretch, an antipinch guard attachment comprising:

(a) a stiff arm of substantial strength;

(b) pivotal mounting means mounting on one end of the arm on the saw adjacent to the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain; and (c) elongated handle means attached to the arm for adjustment angularly relative thereto and for pivotal movement therewith.

2. The combination of claim 1 wherein the handle means comprises an elongated upright member attached adjustably to the arm adjacent the lower end of the upright member and a handgrip attached to the upper end of the upright member.

3. The combination of claim 2 wherein the upright member of the handle means is attached movably to the arm and a first locking means is provided for releasably locking the upright member in a first relative position substantially perpendicular to the arm.

4. The combination of claim 3 wherein a second locking means is provided for releasably locking the upright member in a second relative position substantially parallel to the arm.

5. The combination of claim 1 wherein the handle means of the attachment is bifurcated, having two upstanding members, the arm being attached to the members adjacent the lower ends thereof, and a handgrip fixed to the members between the upper ends thereof.

6. The combination of claim 5 wherein the arm of the attachment is movably attached between the upstanding handle members, and a first locking means is provided for releasably locking the arm in a first relative position substantially perpendicular to the upstanding members.

7. The combination of claim 6 wherein a second locking means is provided for releasably locking the arm in a second relative position substantially parallel to the upstanding members.

8. The combination of claim 5 further comprising a hinge means mounting the upstanding members on the arm, and a detent mounted on the handle and operable to releasably lock the movement of the arm relative to the handle.

9. The combination of claim 8 wherein the pivotal mounting means and the hinge means are coaxial.

10. The combination of claim 1 further comprising a first stop means positioned for stopping the angular movement of the arm at said initial angular position.

11. The combination of claim 10 further comprising a second stop means positioned for stopping the angular movement of the arm at said second angular position.

12. The combination of claim 11 wherein the second step means comprises adjustable stop means.

13. In combination with a chain saw having an outwardly projecting blade mounting a saw chain having a working stretch, an antipinch guard attachment comprising:

(a) a stiff arm of substantial strength;

(b) pivotal mounting means mounting one end of the arm on the saw adjacent the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain;

(c) handle means attached to the arm and pivotal therewith, the handle means comprising an upright member attached movably to the arm and a hand grip attached to the upright member; and (d) locking means for releasably locking the upright member in a position substantially perpendicular to the arm.

14. The combination of claim 13 including second locking means for releasably locking the upright member in a position substantially parallel to the arm.

15. In combination with a chain saw having an outwardly projecting blade mounting a saw chain having a working stretch, an antipinch guard attachment comprising:

(a) a stiff arm of substantial strength;

(b) pivotal mounting means mounting one end of the arm on the saw adjacent the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain;

(c) handle means attached to the arm and pivotal therewith, the handle means being bifurcated, having two upstanding members, the arm being movably attached between the members adjacent the lower ends thereof, and a hand grip fixed to the members between the upper ends thereof, and (d) locking means for releasably locking the arm in a position substantially perpendicular to the upstanding members.

16. The combination of claim 15 including second locking means for releasably locking the arm in a position substantially parallel to the upstanding members.

17. In combination with a chain saw having an outwardly projecting blade mounting a saw chain having a working stretch, an antipinch guard attachment comprising:

(a) a stiff arm of substantial strength;

(b) pivotal mounting means mounting one end of the arm on the saw adjacent the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain;

(c) bifurcated handle means having two upstanding members and a hand grip fixed to the members between the upper ends thereof, (d) hinge means mounting the upstanding members on the arm adjacent the lower ends of the members, and (e) a detent mounted on the handle means and operable to releasably lock the movement of the arm relative to the handle means.

18. The combination of claim 17 wherein the pivotal mounting means and the hinge means are coaxial.

19. In combination with a chain saw having an outwardly projecting blade mounting a saw chain having a working stretch, an antipinch guard attachment comprising:

(a) a stiff arm of substantial strength;

(b) pivotal mounting means mounting one end of the arm on the saw adjacent the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain;

(c) handle means attached to the arm and pivotal therewith; and (d) adjustable stop means positioned for stopping the angular movement of the arm at said second angular position.

20. In combination with a chain saw having an outwardly projecting blade mounting a saw chain having a working stretch, an antipinch guard attachment comprising:

(a) a stiff arm of substantial strength;

(b) pivotal mounting means mounting one end of the arm on the saw adjacent the base of the blade in a plane substantially parallel to the plane of the blade, the arm thereby being pivotal between an initial angular position wherein it extends divergently to the working stretch of the saw chain and a second angular position wherein it is adjacent and substantially aligned with the working stretch of the saw chain;

(c) handle means attached to the arm and pivotal therewith, the handle means comprising an upright member attached movably to the arm and a hand grip attached to the upright member;

(d) first locking means for releasably locking the upright member in a position substantially perpendicular to the arm;

(e) second locking means for releasably locking the upright member in a position substantially parallel to the arm; and (f) adjustable stop means positioned for stopping the angular movement of the arm at said second angular position.

* * * * *